US005301741A

United States Patent [19]

Watson et al.

[11] Patent Number: 5,301,741

[45] Date of Patent: Apr. 12, 1994

[54] CASTING OF METAL STRIP

[75] Inventors: W. Gary Watson, Cheshire; Harvey P. Cheskis, North Haven; Thomas J. Melillo, East Haven, all of Conn.

[73] Assignee: Olin Corporation, New Haven, Conn.

[21] Appl. No.: 513

[22] Filed: Jan. 4, 1993

Related U.S. Application Data

[63] Continuation of Ser. No. 709,556, Jun. 3, 1991, abandoned.

[51] Int. Cl.[5] ..... B27D 11/06

[52] U.S. Cl. ..... 164/461; 164/479; 164/429

[58] Field of Search ..... 164/427, 429, 479, 423, 164/463, 461

[56] References Cited

U.S. PATENT DOCUMENTS 4,030,537 6/1977 Ward ..... 164/433

FOREIGN PATENT DOCUMENTS 242063 10/1962 Australia ..... 164/429
53-146227 12/1978 Japan ..... 164/429
60-72647 9/1983 Japan .
60-83748 5/1985 Japan .
61-49749 3/1986 Japan .
61-219447 9/1986 Japan .

*Primary Examiner*—Kuang Y. Lin
*Attorney, Agent, or Firm*—H. Samuel Kieser

[57] ABSTRACT

A method of casting metal material wherein metallic metal is deposited on a foil moving underneath the feeding means for the molten metal and is supported on a supporting substrate. The foil is formed with side edges before receiving a deposit of molten metal to contain the flow of molten metal thereon in a direction transverse to the direction of movement of the foil.

12 Claims, 1 Drawing Sheet

CASTING OF METAL STRIP

This application is a continuation of application Ser. No. 07/709,556 filed Jun. 3, 1991, and now abandoned.

BACKGROUND OF THE INVENTION

1. Field of the Invention

This invention relates generally to the casting of metal sheet or strip, and more particularly, to an improved method and apparatus for the casting thin metal sheets or strips in a continuous operation.

2. Background Information

The metals industry has been developing processes and apparatus for producing an as-cast product that needs little or no additional processing such as hot rolling that reduces to strip or sheet form. One such process that has arisen as a result of this development is the single or double belt thin strip casting system. In such a process, molten metal is caused to flow onto a moving horizontal surface in the form of an endless belt whereupon it solidifies as it moves along with the belt. The elongated solid strip of metal is removed from the continuous belt for further processing as desired. The endless belts used in these processes provide a substrate through which the heat of solidification is transferred. In order for the belts to have an acceptable service life, intense cooling is required. This intense cooling causes the bottom layer of the incoming liquid metal to freeze very rapidly. Consequently, any folds, oxides or other defects typically caused by the turbulence of the liquid are frozen in. In a thin gauge product, such defects may comprise an unacceptably large proportion of the strip thickness.

Another concern with moving belt systems involves the use of moving or stationary side dams which contain the lateral spreading of the molten metal. Flashing at the joint between the belts and side dams can occur resulting in edge defects in the solidified metal. In the case of stationary side dams, the molten metal may solidify and freeze to the side dam and sticking is possible which in some instances can be severe enough to cause strip separation and termination of the cast.

SUMMARY OF THE INVENTION

It is accordingly an object of the present invention to provide an improved method and apparatus for the continuous casting of metal.

It is a more specific object of the present invention to provide an improved method and apparatus for casting metal which results in an improved thin gauge product.

These and other objects and advantages of the present invention may be accomplished through the provision of the apparatus and process which includes a supporting surface, feeding means located to receive molten metal from a source, and means for continuously positioning a consumable belt foil between the moving surface and the feeding means so that the molten metal is directed onto the foil and becomes bonded thereto.

According to a specific form of the invention, the foil has its edges shaped to provide lateral support for the molten metal.

BRIEF DESCRIPTION OF THE DRAWINGS

The present invention will be better understood by reference to the following detailed description and to the accompanying drawings in which.

DETAILED DESCRIPTION

Figure 1:
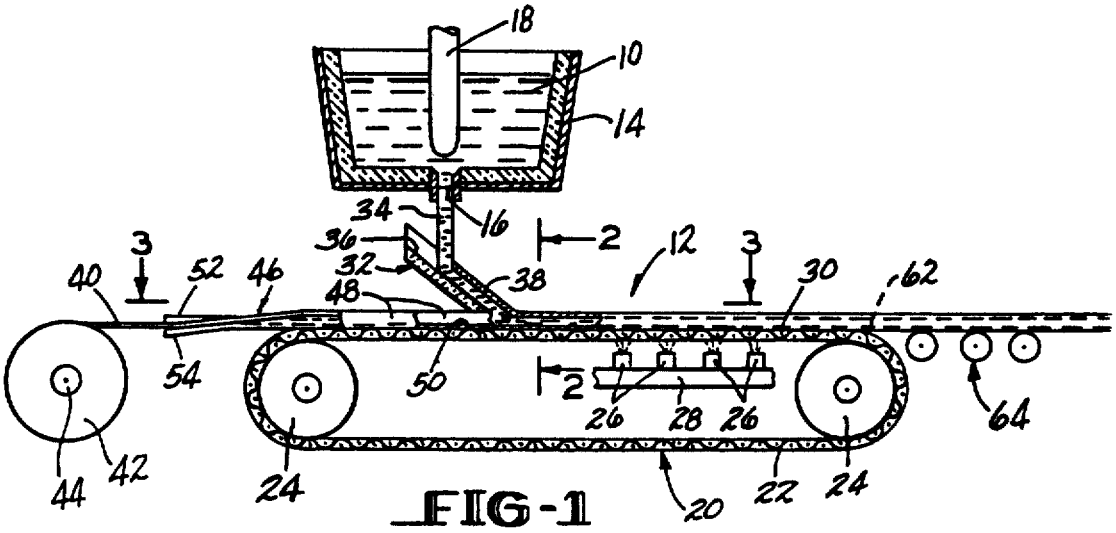
FIG. 1 is a schematic elevational view partly in section of a casting apparatus incorporating the present invention.

Referring to the drawings, and in particular to FIG. 1, there is shown schematically a casting system which incorporates the present invention. The molten metal 10 may be supplied to the casting apparatus 12 from a refractory lined vessel 14 having a discharge opening 16 therein. A plunger 18 is provided in the interior of the vessel 14 which is associated with the discharge opening 16 to control the flow of molten metal from the vessel 14. For this purpose, the plunger 18 may be vertically reciprocated by any suitable mechanism (not shown).

A continuous belt arrangement 20 which provides a supporting substrate is mounted beneath the discharge opening 16 of the vessel 14. The belt arrangement 20 includes a continuous flexible belt 22 entrained about and extending between horizontally spaced rollers 24. One of the rollers 24 may be connected to a suitable drive means (not shown) to drive the belt 22 at the proper speed in the direction of the arrows shown in FIG. 1. The belt 22 for reasons set forth more fully below is preferably made of a mesh material having open spaces therein. The belt is preferably made from stainless steel mesh although any suitable steel alloy may be used. Water jets 26 connected to a manifold 28 may be provided underneath the upper run 30 of the belt 22 to spray water against the underside of the belt for cooling purposes.

Feeding means such as a refractory lined tundish 32 is provided between the vessel 14 and the continuous belt arrangement 20 in a position to be contacted by the stream 34 of molten metal issuing from the outlet 16 of the vessel 14.

Figure 2:
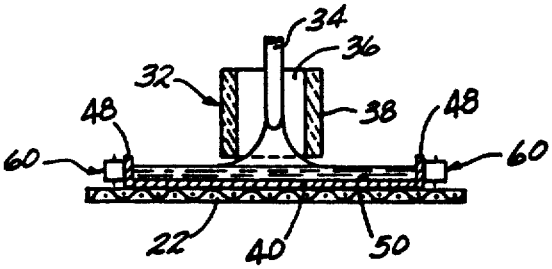
FIG. 2 is a sectional view taken along the lines 2—2 of FIG. 1.
Figure 3:
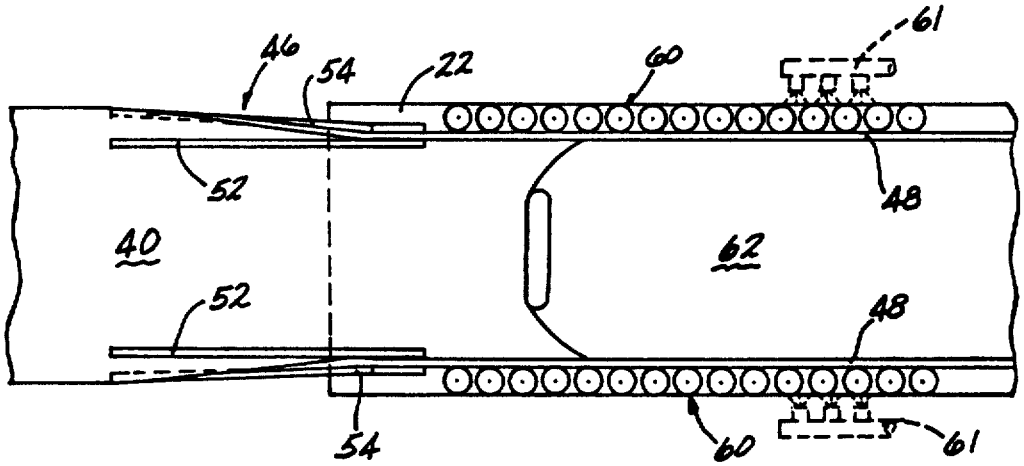
FIG. 3 is a plan view taken along the lines 3—3 of FIG. 1.

The tundish 32 may include a refractory lined trough-like member having a generally flat inclined bottom surface 36 with vertically extending side edges 38. As will be noted in FIG. 2, the width of the planar bottom surface 36 of the tundish 32 is less than the width of the belt 22. The tundish 32 is inclined as shown in FIG. 1 such that its flat or planar bottom surface 36 is inclined downwardly toward the downstream side of the upper run 30 of the continuous belt 22.

A metallic foil 40 is interposed between the upper run 30 of belt 20 and the feeding means 32. The metallic foil 40 may be supplied from a roll or spool 42 rotatably mounted on a suitable shaft 44. The metallic foil 40 extends from the roll 42 across the upper run 30 of the belt as shown in FIG. 1. The foil may either be driven along with the belt 20 or separate drive means for driving the foil may be provided downstream of the belt assembly 20.

Prior to the foil passing underneath the feeding means 32, the foil passes through a shaping station 46 upstream of the feeding means 32 where the side edges 48 of the foil are bent upwardly, substantially perpendicular to the base portion 50 of the foil. This may be accomplished by a series of shaping members 50 Positioned adjacent each edge of the foil. One such member 52 extends parallel to the bottom plane of the foil with its outer side edge at the position at which the foil is bent upward. Another member 54 is inclined upwardly and inwardly to cause the outer side edge portion to bend upwardly and inwardly into its final position substantially perpendicular to the base portion 50 of the foil 40. It is to be understood that other types of shaping means may be provided such as forming rollers or the like. The side edges 48 of the foil 42 in the vicinity of and downstream of the feeding means 32 may be supported by a series of water-cooled rollers 60 as shown. Alternatively, separate side edge sprays (not shown) may be provided.

With the arrangement shown, the molten metal stream 34 flows downwardly from the outlet orifice 16 of the vessel 14 and impacts against the bottom of the tundish 32. The molten metal steam therefore then flows down the inclined bottom surface 34 onto the metallic foil 40 positioned on the top surface of the supporting substrate 20. The molten metal 34 upon contacting the metal foil 40 tends to flow outwardly but is contained there by the side edges 48 of the metallic foil. The molten metal is carried forward by the moving foil 40 where it is solidified into a continuous strip or thin slab and also becomes bonded to the foil. In this sense the foil is considered consumable and is removed from the solidified strip by a conventional Process such as milling. As shown in FIG. 1, the solidified strip 62 with the foil 42 bonded thereto becomes separated from the substrate system 20 and may be either directly coiled or removed on a roller system 64 for further processing including the removal of the consumable metallic foil.

The foil is preferably made from low carbon steel, although any steel alloy ranging from low carbon to stainless steel may be used. The foil must be of sufficient thickness such that the molten metal will bond thereto but not dissolve through it prior to the application of the coolant. As the substrate system 20 is mesh, the water jets 26 spray coolant through the mesh directly onto the bottom surface of the foil, thus improving the heat transfer of the system. The foil preferably should have a thickness of 0.01 inch or less and may generally be between 0.002 and 0.01 inch.

While the foil 42 has been shown in use above in connection with a continuous moving support substrate 20, it is possible to use a fixed support substrate mesh, and cause the foil to move over its upper surface. The foil may be drawn by pinch rollers (not shown) or the like positioned downstream of the feeding means 32 in a position to engage the solidified strip 62 to which the foil is bonded. By virtue of the present invention, complicated side dams are eliminated and the application of coolant to the system may be delayed until the turbulence of the incoming molten metal has a finite time interval to be damped out. As the strip becomes bonded to the foil, no heat barrier exists between the foil and the strip thereby enhancing heat extraction. This enhanced heat extraction promotes directional solidification of the solidifying strip from bottom to top.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A method of casting a metal material into strip or sheet, comprising the steps of:

a. providing a flat supporting substrate beneath a means for feeding molten metal, b. passing a flat metallic foil into a means for forming walls from each of two opposite edge portions of the foil, and then passing the foil from the wall forming means onto the substrate, c. forming, in the wall forming means, an upright sidewall from each of the two opposite side edge portions, d. passing the foil with upright formed sidewalls into a position underneath the means for feeding molten metal, and depositing molten metal on the center portion of the foil while maintaining the center portion of said foil flat, and e. bonding the deposited metal to the center portion of the foil, and f. removing the bonded foil and deposite from the substrate while maintaining the foil bonded to the deposit.

2. The method of claim 1 wherein said supporting substrate comprises a mesh material having an opening therethrough.

3. The method of claim 2 wherein said supporting substrate is stainless steel.

4. The method of claim 1 wherein said metallic foil is a steel alloy.

5. The method of claim 4 wherein said foil is a low carbon steel.

6. The method of claim 4 wherein said foil is stainless steel.

7. The method of claim 4 wherein said foil has a thickness less than about 0.01 inch.

8. The method of claim 4 wherein said foil has a thickness of from about 0.002 inch to about 0.01 inch.

9. The method of claim 1 further comprising continually moving said supporting substrate through a position underneath the means for feeding said molten metal, said foil being moveable with said supporting substrate.

10. The method of claim 1 further comprising the step of:

maintaining said sidewalls generally upright while the molten metal is fed onto the central portion and while the molten metal solidifies.

11. The method of claim 10 further comprising the step of:

cooling the molten metal by directly contacting the foil with liquid coolant during said maintaining step.

12. The method of claim 11 wherein said cooling step includes directly contacting the formed sidewalls with liquid coolant.

* * * * *